United States Patent [19]

Klie

[11] 4,112,973

[45] Sep. 12, 1978

[54] CONTROL ARRANGEMENT FOR A HYDROSTATIC AXIAL OR RADIAL PISTON MACHINE

[75] Inventor: Jürgen Klie, Sprockhovel, Fed. Rep. of Germany

[73] Assignee: G. Duesterloh GmbH, Sprockhoevel, Fed. Rep. of Germany

[21] Appl. No.: 813,492

[22] Filed: Jul. 7, 1977

[30] Foreign Application Priority Data

Jul. 8, 1976 [DE] Fed. Rep. of Germany ..... 2630673

[51] Int. Cl.[2] ..... F16K 11/02

[52] U.S. Cl. ..... 137/625.21; 251/175; 251/185

[58] Field of Search ..... 137/625.21, 625.23; 251/172, 174, 175, 176, 180, 185

[56] References Cited

U.S. PATENT DOCUMENTS

| | | | |
|---|---|---|---|
| 3,584,648 | 6/1971 | Lubos | 137/625.21 |
| 3,626,981 | 12/1971 | Nilsen | 137/625.21 |

*Primary Examiner*—Alan Cohan

*Attorney, Agent, or Firm*—Michael J. Striker

[57] ABSTRACT

Control arrangement for a reversible hydrostatic axial or radial piston machine comprises a fluid guiding outer annular space surrounding a control body consisting of an eccentric disk connected to the shaft of the machine for rotation therewith and an inner control ring which is freely turnable on the periphery of the disk, as well as an outer control ring telescopingly and sealingly guided on the inner control ring, in which the rings are hydraulically and by spring pressed apart in axial direction, with one of the control rings engaging with an end face thereof a planar control face of the machine and the other of the control rings engages with an end face thereof a planar support face, which is axially spaced from and parallel to the planar control face, and wherein the eccentric disk has a hub surrounding the shaft and having an end face which, supported by the force of a spring, is hydraulically pressed against the control face, whereby the disk with the end face on its hub and one of the control rings with its end face pressed against the support face limit a fluid guiding inner annular space which is sealed towards the shaft.

12 Claims, 3 Drawing Figures

CONTROL ARRANGEMENT FOR A HYDROSTATIC AXIAL OR RADIAL PISTON MACHINE

BACKGROUND OF THE INVENTION

The present invention relates to a control arrangement for a reversible hydrostatic axial or radial piston machine, which mainly comprises a fluid guiding outer annular space surrounding a control body which is constituted by an eccentric disk connected to the shaft of the machine for rotation therewith and an inner control ring which is freely turnable on the periphery of the disk, as well as an outer control ring which is telescopingly and sealingly guided on the inner control ring, in which the rings are hydraulically and by a spring pressed apart in axial direction, with one of the control rings engaging with an end face thereof a planar control face of the machine and the other of the control rings engaging with an end face thereof a planar support face, which is axially spaced from and parallel to the planar control face. The eccentric disk has a hub surrounding the shaft and being provided with an end face which, supported by the force of a spring, is hydraulically pressed against the control face, whereby the disk, with the end face on its hub, and one of the control rings, with its end face pressed against the support face, limit a fluid guiding inner annular space which is sealed toward the shaft.

In a known construction of a control arrangement of the aforementioned kind, the commutation of the fluid is provided by means of a telescopic ring arrangement supported by a roller bearing and translatory moved by an eccentric disk. Characteristic for this construction are two annular spaces which are sealed against each other by the control rings and which are flown through by the fluid, whereby in the inner annular space a roller bearing is arranged which maintains a distance between the inner control ring and the eccentric disk. This known construction operates successfully since the friction losses produced thereby are very small so that the wear of this arrangement is practically zero, resulting in a long operating life thereof. This known arrangement may further be used with high fluid pressures, a high number of revolutions per minute and with high temperatures. In addition, it is not detrimentally influenced by temperature shocks or by fowling of the fluid.

Despite these, for the practical operation of this arrangement, favorable conditions, the known control arrangement has still some characteristics which could be improved and which limit the use of the arrangement. One of these characteristics is the necessity of a relatively large number of auxiliary parts for the sealing of the annular spaces and for movement of the control rings, which auxiliary parts have in addition to be manufactured to very close tolerances. Additional auxiliary parts with close tolerances evidently increase the cost of manufacturing of such a control arrangement and which correspondingly decrease considerably the commercial use thereof. If large fluid streams have to be guided through this known control arrangement with acceptable losses, then a further characteristic thereof is, that depending on the size of the arrangement, relatively large axially and radially extending mounting spaces are required. In addition, in the known control arrangement it is not possible to seal the eccentric disk towards a leakage space in such a manner, that according to the laws of hydrostatics an actually sufficient seal with the smallest possible friction can be derived.

It is further of importance in such control arrangements according to the prior art, that, in addition to the presence of a great number of high pressure seals, a roller bearing, flown through by fluid, is provided in the inner annular space between the eccentric disk and the inner control ring. Such a roller bearing, regardless of what construction, requires not only a relatively large mounting space, whereby the dimensions of the control arrangement, and therewith those of the complete machine, are increased, but such a roller bearing produces also very high losses in the fluid stream. Such losses will result in the transformation of a part of the energy input in heat, which will result in an increase of the operating temperature and a considerable change in the viscosity of the hydraulic fluid. This will result in a power loss so that at an acceptable efficiency of the machine the upper limit of the revolutions thereof is restricted.

SUMMARY OF THE INVENTION

It is an object of the present invention to provide a control arrangement of the aforementioned kind which includes the advantageous characteristics of the known control arrangements, but which is improved with respect to the fluid flow losses and the inner sealing of the arrangement.

It is a further object of the present invention to reduce the manufacturing cost of the control arrangement, as well as the dimensions thereof.

These objects of the present invention are obtained in that the eccentric disk, which is in direct sliding contact with the inner control ring and which is provided with relatively large axially extending bores and/or cutouts therethrough has an annular face which is pressed by a spring element, which supports (i.e. supplements), respectively replaces, the hydraulic pressure acting on the eccentric disk, against the control face of the housing. The spring element is arranged between the eccentric disk and a sealing body, which is axially movable with respect to the eccentric disk and which engages with an annular sealing face thereof a support face of the housing in which the control arrangement is arranged.

Essential characteristics according to the present invention are the axial bores and/or cutouts of relatively large area which are provided in the eccentric disk, and which are made possible by the omission of the roller bearing between the inner control ring and the eccentric disk. The arrangement and construction of the axial bores and/or cutouts can be made in various different ways. Thus, for instance, the eccentric disk may have a peripheral cylindrical surface which is in sliding contact with the inner control ring. In this case a plurality of axial bores of large diameter are provided in the eccentric disk. Between the axial bores and the peripheral surface of the eccentric disk only so much solid material remains which will assure the stability of the eccentric disk. In another form of construction, the eccentric disk may be provided with large cutouts extending from the periphery of the disk into the latter so that the periphery of the disk is only in sliding contact with the inner control ring over relatively short diametrically opposite peripheral portions. In this construction additional axial bores may be provided through the remaining surface areas of the disk. The length of the peripheral contact portions of the eccentric disk, which engage the inner control ring, has to be dimensioned in such a manner that a kinematic connection of the eccentric disk and the inner control ring is assured, to thereby also assure a translatory movement of the control rings.

The essential advantage of the relatively large axial bores through the eccentric disk and/or the cutouts provided on the periphery thereof is an essential reduction of the dynamic pressure as well as an essential reduction of the fluid flow losses. Due to the reduction of the fluid flow losses it is possible to operate the arrangement according to the present invention with higher revolutions per time unit than the arrangements according to the prior art. The efficiency at higher revolutions per time unit will also be essentially increased. The operating temperature is reduced so that changes in the viscosity of the hydraulic working fluids will remain very small.

An essential further characteristic according to the present invention is constituted by a sealing body which is connected to the shaft of the machine for rotation therewith, but which is axially movable relative to the eccentric disk and which abuts with an annular sealing face thereof against a support face of the machine housing. This characteristic provides for a condition that a free choice of the inner and outer diameter of the end face of the eccentric disk, on the one hand, and the outer diameter of the sealing body as well as the inner and outer diameters of the sealing face thereof, on the other hand, permits a substantially optimal dimensioning of the hydrostatic forces which respectively press the eccentric disk and the sealing body axially in opposite directions.

A further advantage of the present invention is that the sealing body telescopingly reaches, in a sealed manner, into a cavity in the eccentric disk. In this way a perfect seal between the sealing body and the eccentric disk is derived with relatively simple means. In addition the cost of manufacturing of the cylindrical sealing face on the sealing body and on the eccentric disk is very small. The seal can thereby be obtained by a sealing ring which is arranged in a corresponding annular groove of the eccentric disk.

A further advantageous characteristic according to the present invention is that, in the pretensioned condition, the axial length of the control rings is equal to the axial length of the eccentric disk including the sealing body. This characteristic permits a simple construction of the support face which can be constructed as a planar face. Likewise the end faces of the control rings, the end face of the eccentric disk and the sealing face on the sealing body may be manufactured exactly and in a simple manner. The cost of manufacturing of these elements is thereby reduced and the mounting thereof simplified.

In this connection it is further advantageous according to the present invention that the support face of the machine housing is constituted by a plane surface of a pressure block releasably connected to the housing. The pressure block can thereby be formed by a disk which is sealingly inserted into an open end of the machine housing and fixed to the latter. It is however also possible to arrange the housing section, which receives the control member, releasably from the so-called cylinder block of the machine housing and the pressure block releasable in this housing section.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
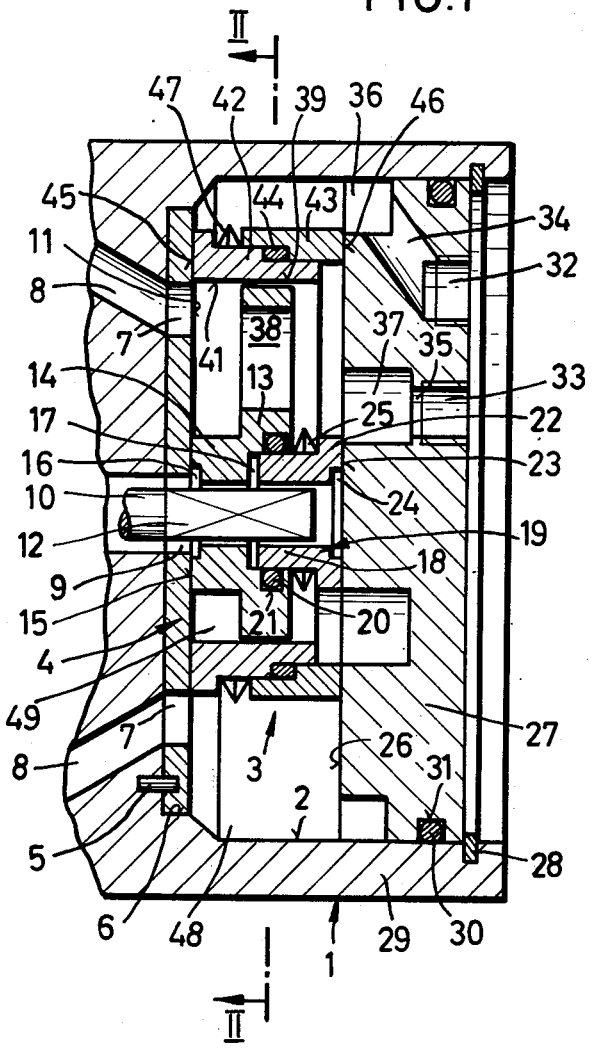
FIG. 1 is an axial cross-section of the control arrangement of a hydrostatic radial piston machine.
Figure 2:
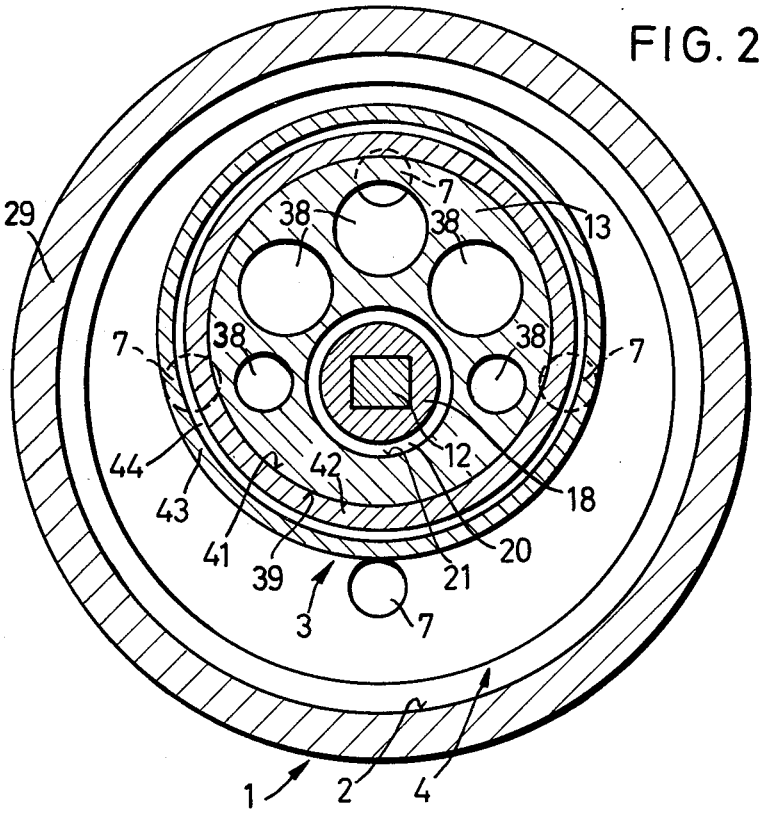
FIG. 2 is a cross-section through the control arrangement, taken along the line II—II of FIG. 1.

FIGS. 1 and 2 show part of the housing 1 of a radial piston machine. The housing 1 is formed at one end thereof with a post-shaped cavity 2 for the mounting of the control arrangement 3. The bottom of the cavity 2 is constituted by a relatively thin control plate 4 of steel, which is secured against turning relative to the housing by means of a dowel 5. The control plate 4 is fitted into a depression 6 at the bottom of the housing cavity.

The control plate 4 is provided with control openings 7, which communicate through control channels 8 with the cylinders of the radial piston machine, not shown in the drawing. The control plate 4 has further a central bore 9 through which the machine shaft 10 passes with considerable clearance. The control surface 11 of the control plate 4 which faces the cavity 2 is planar ground.

The end section of the machine shaft 10, which projects beyond the control plate 4 into the cavity 2, has a square cross-section. An eccentric disk 13, having a thickness about twice that of the control plate 4, is mounted for rotation with the shaft 10 on the square cross-section of the latter by means of a hub 14 projecting toward the control plate 4. The hub 14 has a plane annular end face 15 engaging the control face 11. The end face 15 is delimited, on the one hand, by the outer circumference of the hub 14, and, on the other hand, by a central depression 16 in the hub 14. The length of the hub 14 corresponds substantially to the thickness of the eccentric disk 13. However, the length of the hub 14 can also be dimensioned much shorter.

A cylindrical cavity 17 is provided in the eccentric disk 13, coaxial with the hub 14, and extending into the eccentric disk 13 from the side opposite the side from which the hub projects. The depth of the cavity 17 corresponds substantially to the thickness of the eccentric disk 13. A cylindrical extension 18 of a sealing body 19 extends with a sliding fit into the cavity 17. This sealing body 19 is likewise mounted on the square end portion 12 of the machine shaft for rotation therewith, but movable in axial direction relative to the eccentric disk 13. An annular seal 20, mounted in an annular groove 21 of the eccentric disk 13, seals the cylindrical extension 18 of the sealing body 19 against the cavity 17 formed in the eccentric disk 13.

The sealing body 19 has an end section 22 of a diameter greater than the extension 18 thereof, and the end section 22 has an end face in form of an annular planar sealing face 23. The annular sealing face 23 is delimited, on the one hand, by the outer circumference of the end section 22 and, on the other hand, by a central cavity 24 provided in the sealing body 19. A spreading means, in form of a relatively weak spring element 25, is arranged between the end section 22 of the sealing body 19 and the eccentric disk 13. The spring force of the spreading means is chosen in such a manner that the end face or pressure face 15 of the hub 14 and the sealing face 23 of the sealing body 19 abut at low pressure, respectively in the pressureless condition, with sufficient pressure against the control face 11, respectively the support face 26 of the housing.

The above-mentioned support face 26 is formed by a planar surface of a disk-shaped pressure block 27 mounted in the open end of the cavity 2. The pressure block 27 is secured in the open end of the cavity 2 by a locking ring 28. A sealing ring 30, located in an annular groove of the pressure block 27, seals the latter with respect to the annular housing wall 29.

FIG. 1 shows also the connections 32 and 33 for the working fluid as well as the connecting channels 34 and 36 providing communication between the connections 32 and 33 and the annular channels 36 and 37 in the pressure block 27. The connections 32 and 33 serve, depending on the direction of rotation of the machine, as inlet, respectively outlet openings for the fluid.

As can be seen from FIGS. 1 and 2, the eccentric disk 13 is provided with a plurality of axial bores 38 therethrough. The diameter of each of these bores is dimensioned in such a manner so that only so much material will remain between the outer circumference of the eccentric disk, respectively between the central bore 17 therethrough, and the bores 38, that the stability of the eccentric disk is not detrimentally influenced. In this way openings of relatively large cross-section are formed in the eccentric disk, which will assure a high throughput of working fluid from the control channels 8 to the connections 32 and 33, respectively in the opposite direction. In this construction shown in FIG. 2 there is a total of five bores provided, of which three of these bores have a larger diameter than the remaining two bores. Instead of bores openings of other cross-section may also be provided in the eccentric disk 13.

Figure 3:
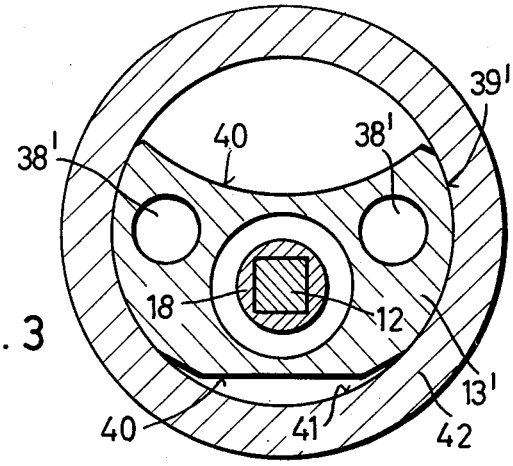
FIG. 3 is a modification of the eccentric disk shown in FIGS. 1 and 2, shown in cross-section taken substantially along the line of the cross-section of FIG. 2.

FIG. 3 shows a modification of the eccentric disk. The eccentric disk 13' shown in FIG. 3 has, instead of the bores 38 according to the construction as shown in FIGS. 1 and 2, cutouts 40 extending from the periphery of the eccentric disk 13' into the latter. In the remaining solid portion of the eccentric disk 13' are further two bores 38' arranged.

In the construction of the eccentric disk 13 shown in FIGS. 1 and 2, as well as in the modification of the eccentric disk 13' shown in FIG. 3, the eccentric disks are, over their whole outer circumference, respectively over part 39' of this circumference (in the modification according to FIG. 3) in sliding contact with the inner circumference 41 of an inner control ring 42. The inner control ring 42 is in a sealed manner and telescopingly guided on an outer control ring 43. The seal between the two control rings comprises an annular seal 44 arranged between shoulders of the two control rings.

The end faces 45 and 46 of the control rings 42 and 43, facing away from each other, are respectively in sliding contact with the control face 11 of the control plate 4 and the support face 26 on the pressure block 27. A spring element 47 is arranged between the two control rings 42 and 43, which presses the latter in axial direction away from each other and respectively against the above-mentioned faces 11 and 26. The axial length of the two control rings 42 and 43 in the pretensioned condition is equal to the axial length of the eccentric disk 13 including the hub 14 and the sealing body 19 inserted into the cavity 17 of the eccentric disk. In this way it is possible to form the end faces 45 and 46 of the control rings, the control face 11 of the control plate 4, the supporting face 26 of the pressure block 27, the end face 15 on the hub 14, as well as the sealing face 23 of the sealing body 19 as planar faces.

Due to the axial pretension, the end face 45 of the inner control ring 42 and the end face 15 of the hub 14 abut continuously against the control face 11 of the machine housing 1 and the end face 46 of the outer control ring 43 and the sealing face 23 of the sealing body 19 abut permanently onto the support face 26 of the pressure block 27. In this way an outer and an inner annular space 48, respectively 49, are formed which, during rotation of the shaft, connect, due to the control rings 42 and 43 which are freely rotatable on the eccentric disk 13, respectively 13', the control channels 8 with the connections 32, respectively the connection 33.

It will be understood that each of the elements described above, or two or more together, may also find a useful application in other types of control arrangements for reversible hydrostatic axial or radial piston machines, differing from the types described above.

While the invention has been illustrated and described as embodied in a control arrangement for a reversible hydrostatic axial or radial piston machine, it is not intended to be limited to the details shown, since various modifications and structural changes may be made without departing in any way from the spirit of the present invention.

Without further analysis, for foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A control arrangement for a reversible hydrostatic piston machine, comprising housing means forming a planar control face and an opposite planar support face axially spaced from said control face; a machine shaft extending into said housing means coaxial therewith; a control body in said housing means between said control face and said support face and comprising an eccentric disk connected to said shaft for rotation therewith and having a peripheral surface and an inner and an outer control ring surrounding said peripheral surface of the eccentric disc and being telescopically guided in a sealed manner within each other, said control rings being hydraulically pressed apart in axial direction so that one of said control rings sealingly engages with one end face thereof said planar control face and the other of said control rings engages with an end face thereof said planar support face, said inner control ring having an inner surface in sliding contact with said peripheral surface of said eccentric disk, said eccentric disk being provided with fluid passages of relatively large cross-section therethrough and having a hub surrounding said shaft, said hub having an end face which is hydraulically pressed against said control face, said eccentric disk with the end face of the hub thereof engaging said control face forms together with said one sealing ring, the end face of which engages likewise said control face, an inner annular fluid guiding space which is sealed towards said shaft, said control rings forming between the outer peripheral surface thereof and said housing means an outer fluid guiding annular space;

fluid guiding channels respectively communicating with said inner and said outer fluid guiding annular spaces; a sealing body connected to said shaft for rotation therewith but axially movable relative to said eccentric disk, said sealing body having an annular sealing face abutting against said support face; and spring means between said sealing body and said eccentric disk for urging said end face of said hub against said control face, with a predetermined minimum force irrespective of the presence or absence of hydraulic pressure.

2. A control arrangement as defined in claim 1, and including spring means between said control rings for supporting the hydraulic pressure with which the end faces thereof are pressed against said control face and said support face.

3. A control arrangement as defined in claim 1, wherein said sealing body has a surface opposite said annular sealing face thereof which is impinged by fluid so as to provide an axial force pressing said sealing body against said support face, and wherein said eccentric disk has a surface opposite said end face on said hub which is impinged by fluid so as to provide an axial force pressing said eccentric disk against said control face, and wherein the relationship of the area of said surface of said sealing body to said annular sealing face thereof as well as the relationship of the area of the surface of said eccentric disk to said end face of the hub thereof is about 1.3 to 0.5.

4. A control arrangement as defined in claim 1, wherein said eccentric disk has a cylindrical recess and said sealing body has a cylindrical projection slidably guided in said recess, and a sealing ring in said recess and sealingly engaging said projection of said sealing body.

5. A control arrangement as defined in claim 2, wherein in the prestressed condition the axial length of said telescoping sealing rings is equal to the axial length of the eccentric disk and said sealing element.

6. A control arrangement as defined in claim 1, wherein said housing means has an open end, and including a pressure block releasably inserted in and closing said open end thereof, said pressure block having an inner planar face constituting said support face.

7. A control arrangement as defined in claim 6, wherein said housing means has a peripheral wall formed with an annular groove adjacent said open end, and including a locking ring in said groove for releasably holding said pressure block in said open end of said housing means.

8. A control arrangement as defined in claim 6, wherein said housing means includes further a control plate having an inner planar face parallel to and spaced from said support face and constituting said control face.

9. A control arrangement as defined in claim 8, wherein said control plate is formed with a central opening through which said shaft extends and a plurality of further openings respectively communicating with said annular fluid guiding spaces and said fluid guiding channels, and including means preventing turning of said control plate relative to the remainder of said housing means.

10. A control arrangement as defined in claim 1, wherein said fluid passages provided in said eccentric disk are constituted by a plurality of axial bores extending circumferentially spaced from each other through said disk.

11. A control arrangement as defined in claim 1, wherein said fluid passages provided in said eccentric disk include at least one large cutout extending from the periphery of said disk into the latter.

12. A control arrangement as defined in claim 1, wherein said spring means comprise a spring having a spring force sufficient to urge said end face of said hub against said control face even when said arrangement is in pressureless condition.

* * * * *